US007207071B2

(12) United States Patent
Pierce

(10) Patent No.: US 7,207,071 B2
(45) Date of Patent: Apr. 24, 2007

(54) VENTILATED HELMET SYSTEM

(75) Inventor: Brendan Erik Pierce, San Jose, CA (US)

(73) Assignee: Fox Racing, Inc., Morgan Hill, CA (US)

( * ) Notice: Subject to any disclaimer, the term of this patent is extended or adjusted under 35 U.S.C. 154(b) by 0 days.

(21) Appl. No.: 10/871,358

(22) Filed: Jun. 18, 2004

(65) Prior Publication Data

US 2005/0278833 A1 Dec. 22, 2005

(51) Int. Cl.
*A42B 3/00* (2006.01)

(52) U.S. Cl. ..... 2/410; 2/414; 2/424; 2/437

(58) Field of Classification Search ..... 2/410, 2/411, 412, 414, 424, 425, 436, 437, 171.3
See application file for complete search history.

(56) References Cited

U.S. PATENT DOCUMENTS 4,612,675 A * 9/1986 Broersma ..... 2/424
4,615,052 A * 10/1986 Nava ..... 2/424
4,627,115 A * 12/1986 Broersma ..... 2/425
5,136,657 A * 8/1992 Hattori ..... 381/181
5,361,419 A * 11/1994 Bernstein ..... 2/423
5,388,277 A * 2/1995 Taniuchi ..... 2/422
6,256,797 B1 * 7/2001 Nemoto et al. ..... 2/414
6,421,841 B2 * 7/2002 Ikeda ..... 2/414
6,763,526 B1 * 7/2004 Hong ..... 2/171.3
6,925,657 B2 * 8/2005 Takahashi et al. ..... 2/412

FOREIGN PATENT DOCUMENTS

DE 3419302 A1 * 11/1985
EP 781515 A1 * 7/1997
FR 2630603 A1 * 10/1989

* cited by examiner

*Primary Examiner*—Rodney Lindsey
(74) *Attorney, Agent, or Firm*—Michael A. Guth

(57) ABSTRACT

A ventilation system for a helmet that allows for ventilation of the interior of a helmet. A ventilation system for the cheek bar portion of a helmet, including a motorcycle helmet. The ventilation system may include ribbed passageways that facilitate airflow along the interior of the helmet, and may include access openings in an intermediate portion that couple the airflow from the ribbed passageways to the area of the helmet in contact with the user.

9 Claims, 10 Drawing Sheets

VENTILATED HELMET SYSTEM

BACKGROUND OF THE INVENTION

1. Field of Invention

The invention relates in general to the field of helmets, and more specifically to a ventilation system for a motorcycle helmet and motorcycle helmet cheek bar.

2. Description of Related Art

Safety helmets for motorcycles are typically made in the form of a complete cap that provides an opening in the area of the user's eyes. The helmets are generally provided with an external shell, made from a rigid and strong material, such as polycarbonate, or composite materials, coupled with safety padding inside the shell. The safety padding is often made of expanded polystyrene, expanded polypropylene, or foamed polyurethane, and is itself often lined with a soft material in order to provide comfort to the wearer.

In the case of a full face helmet with an integral face or cheek bar, ventilation becomes an important issue. Ventilation is often required both for cooling and to exhaust moisture caused by sweat coming from the rider. The need for ventilation occurs both in the volume under the main shell and in the area of the cheek bar. Ventilation in the area of the cheek bar is also important because this is an area where the user's face, and skin, will be in direct contact with the helmet lining. In the area of the main shell, the user's hair will generally be in contact with the lining. Thus, for reasons of comfort, the cheek bar is of special concern. In addition, the ventilation of moisture out from under the cheek bar may help to reduce moisture from interfering with the user's vision, such as by the fogging of a face shield or of goggles.

Prior art devices have addressed the need for ventilation in motorcycle helmets. For example, U.S. Pat. No. 5,086,520 to Arai utilizes an air inlet on the top portion of the shell to allow for the introduction of air into the shell. This device delivers air to the top of the head and is limited in the manner in which it can cool or dehumidify the interior of the helmet shell.

U.S. Pat. No. 4,555,816 to Broersma illustrates a motorcycle helmet which utilizes air inlets in the cheek bar itself. Although the air inlet is in the external portion of the cheek bar, the air itself is routed outside the foamed polyurethane liner and then through passages where it can then ventilate the sides, top, and rear of the user's head.

When riding in hot weather or during the rigors of physically strenuous riding, the face area of the user in contact with the inside of the cheek bar is likely to become overheated. In addition, this is an area where the user's skin is typically in direct contact with the interior of the helmet. Prior art devices do not adequately address the need for ventilation in the area of the user's face contact area to the cheek bar.

What is called for is a ventilation system that is capable of delivering cooling air and removing moisture from the interior area of a helmet, and especially where the user's face is in contact with the interior of the helmet's cheek bar. What is also called for is a ventilation system that meters the air flow so delivered.

BRIEF SUMMARY OF THE INVENTION

A ventilation system for a helmet that allows for ventilation of the interior of a helmet. A ventilation system for the cheek bar portion of a helmet, including a motorcycle helmet. The ventilation system may include ribbed passageways that facilitate airflow along the interior of the helmet, and may include access openings in an intermediate portion that couple the airflow from the ribbed passageways to the area of the helmet in contact with the user.

DETAILIED DESCRIPTION

Figure 1:
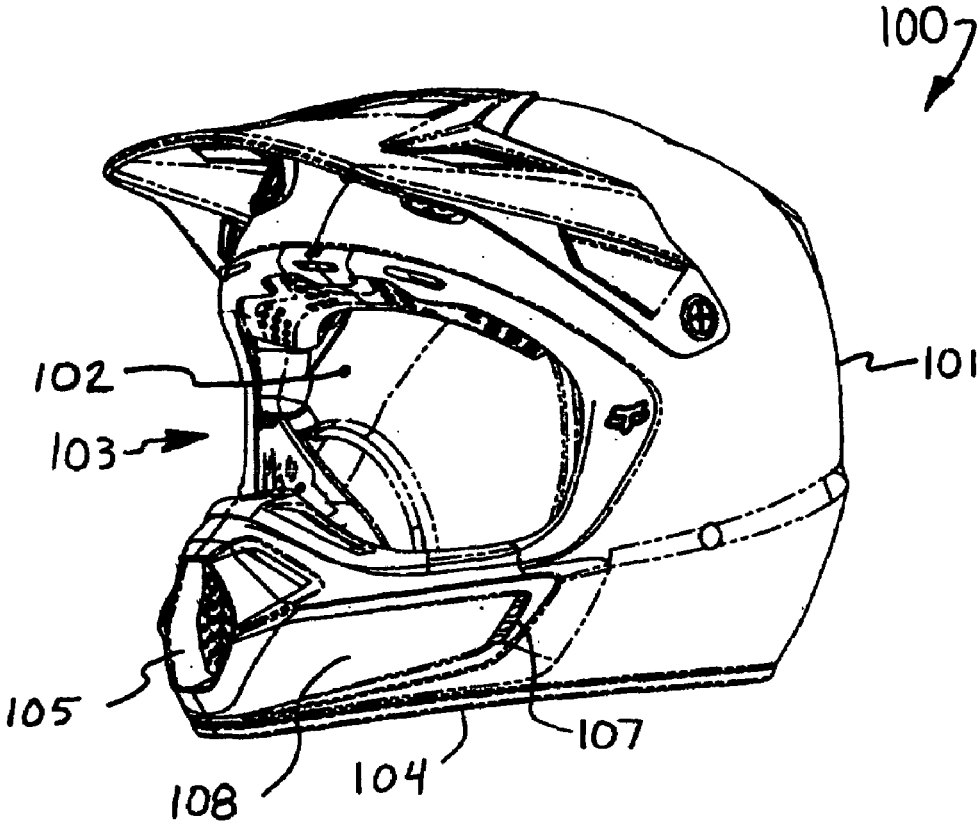
FIG. 1 is an illustration of a helmet including a chin bar.

FIG. 1 illustrates a motorcycle helmet 100 according to one embodiment of the present invention. Outer shell 101 is a high strength shell that forms most of exterior of helmet 100. Outer shell 101 may be constructed of carbon fibers, kevlar, fiberglass, injection molded plastics, or other types of materials in some embodiments. The chin bar 104 represents the portion of helmet 101 extending forward from the area around the front lower sides of the helmet 101, from approximately in the area below the user's ears, towards the front of the helmet 101. In some embodiments, the chin bar 104 is attached to the helmet 101 as a co-formed portion of the outer shell 101. In some embodiments, the chin bar 104 is manufactured as a separate piece and attached to the helmet 101 using fasteners or other appropriate methods. The front opening 103 is an opening allowing the user to see out from under the helmet during use. Typically, the front opening 103 is of sufficient size to allow for goggles to be worn by the user without interfering with the helmet 101.

The helmet liner 102 typically resides within the outer shell 101. The helmet liner 102 may be predominantly constructed of expanded polystyrene (EPS) in some embodiments. Typically, the outer contour of the helmet liner 102 conforms substantially to the inner contour of the outer shell 101. Typically, the outer contour of the helmet liner 102 is in substantial contact with the inner contour of the outer shell 101. In some embodiments of the present invention, the helmet liner 102 may be lined with a comfort liner. In some embodiments, the comfort liner may have a lining made of cloth fabric or other materials. In some embodiments, the comfort liner may be a combination of multiple cushion portions.

In some embodiments of the present invention, the forward portion of the chin bar 104 has a front vent 105. The front vent 105 allows for the introduction of air into the helmet 101. In some embodiments, the air that passes through the front vent 105 may be routed in to ducts or air passages. In some embodiments, the front vent 105 may have a filter or dust cover residing within the opening of the vent or adjacent to the opening. In some embodiments, the helmet 101 may have one or more side vents 107. A depression 108 may reside in the outer shell of the chin bar 104 to facilitate the air flow through the vent 107. The depression 108 allows the side vent 107 to be recessed into the outer shell of the chin bar 104.

Figure 2:
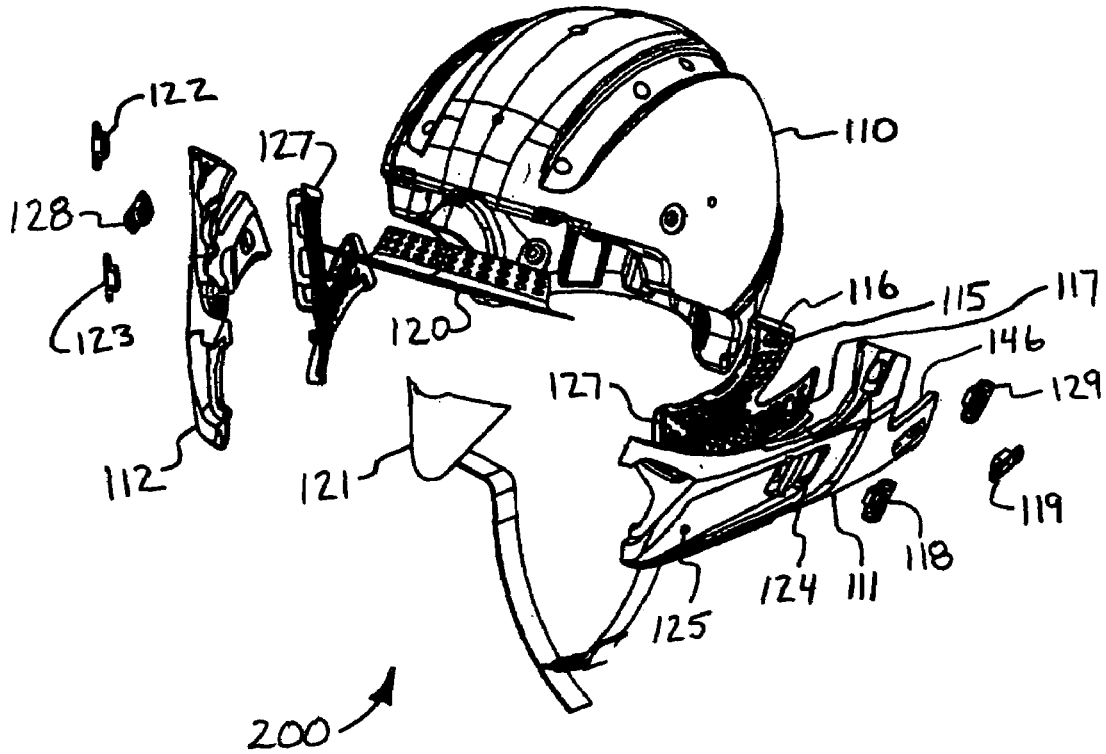
FIG. 2 is an exploded pictorial view of interior components of the helmet according to one embodiment of the present invention.

In some embodiments of the present invention, as seen in FIG. 2, a helmet interior portion 200 resides within the outer shell 101. The helmet liner 110 resides within the outer shell (not shown in FIG. 2). In some embodiments, the helmet liner 110 is made of expanded polystyrene (EPS). The chin bar pads 111, 112 reside within the portion of the outer shell that protrudes across the user's chin. In some embodiments, the chin bar pads 111, 112 are made of expanded polystyrene (EPS). In some embodiments, the density of the EPS used in the chin bar pad is of a different density than that of the helmet liner 110. In some embodiments, the density of the EPS used in the chin bar pad is of a higher density than that of the helmet liner 110. The chin bar pads 111, 112 may have an inlet duct 124 to allow for air flow through the chin bar pads 111, 112. In some embodiments, chin bar pad depression 125 is used to facilitate air flow into the inlet duct 124, and for other reasons. In some embodiments, the outer shell 101 may have a depression that substantially conforms to the chin bar pad depression 125. In some embodiments of the present invention, cheek pads (not shown in this view) are used between the chin bar pads 111, 112 and the user's face. In some embodiments, the cheek pads have a cheek pad base 115, 127. The cheek pad base 115, 127 is adapted to reside against the interior surface of the chin bar pads 111, 112 in some embodiments.

In some embodiments, the cheek pad base 115 may be attached to the chin bar pad 111 by inner clips 116, 117, 127 that connect to outer clips 118, 119, 129, thus fastening the cheek pad base 115 to the chin bar pad 111. The cheek pad base 127 may be connected using outer clips 122, 123, 128. In some embodiments, a different type of clips is used. In some embodiments, other attachment methods are used to attach the cheek pad to the chin bar pad. A dust filter 121 may be inserted into the front vent 105. In some embodiments, the dust filter 121 is made from polyurethane foam. A forehead bridge 120 is mounted within the front upper portion of the helmet liner 110 in some embodiments.

Figure 3:
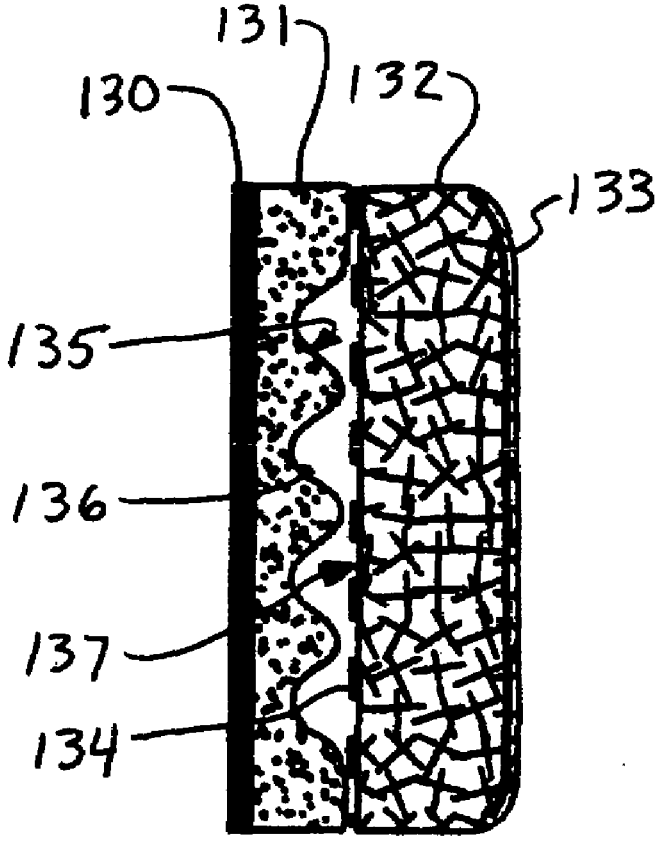
FIG. 3 is a cross-sectional representation of a view of the chin bar according to one embodiment of the present invention.

FIG. 3 represents a cross-sectional view of the chin bar 104 according to some embodiments of the present invention. The chin bar outer shell portion 130 is lined with a chin bar pad 131 which is substantially in contact with the chin bar outer shell portion 130 in this embodiment. The top surface 135 of the chin bar pad 131 has an uneven top surface which includes depressions 136 that form a ridged duct portion of the chin bar pad 131. In some embodiments, the uneven surface may reside against the interior surface of the outer shell and the depressions may be fluidically coupled to the inner surface of the chin bar pad through holes or other means. A cheek pad 132 resides adjacent to the chin bar pad 131. In some embodiments, the cheek pad 132 may have a cheek pad base 134. The cheek pad base may have a plurality of holes 137, which allow for the flow of air through the cheek pad 132, which may be of a porous hydrophilic foam in some embodiments. In some embodiments, the holes 137 in the cheek pad base may predominantly align with the depressions 136. The cheek pad base 134 may provide a relatively rigid backing to the cheek pad 132, allowing for compression of the cheek pad 132 during use without allowing the cheek pad 132 to compress into the depressions 136, which may inhibit or block the air flow through the depressions 136. The cheek pad 132 may have a liner 133 in some embodiments. The liner 133 may be cloth in some embodiments. The liner 133 may be of a moisture wicking material in some embodiments.

Figure 4:
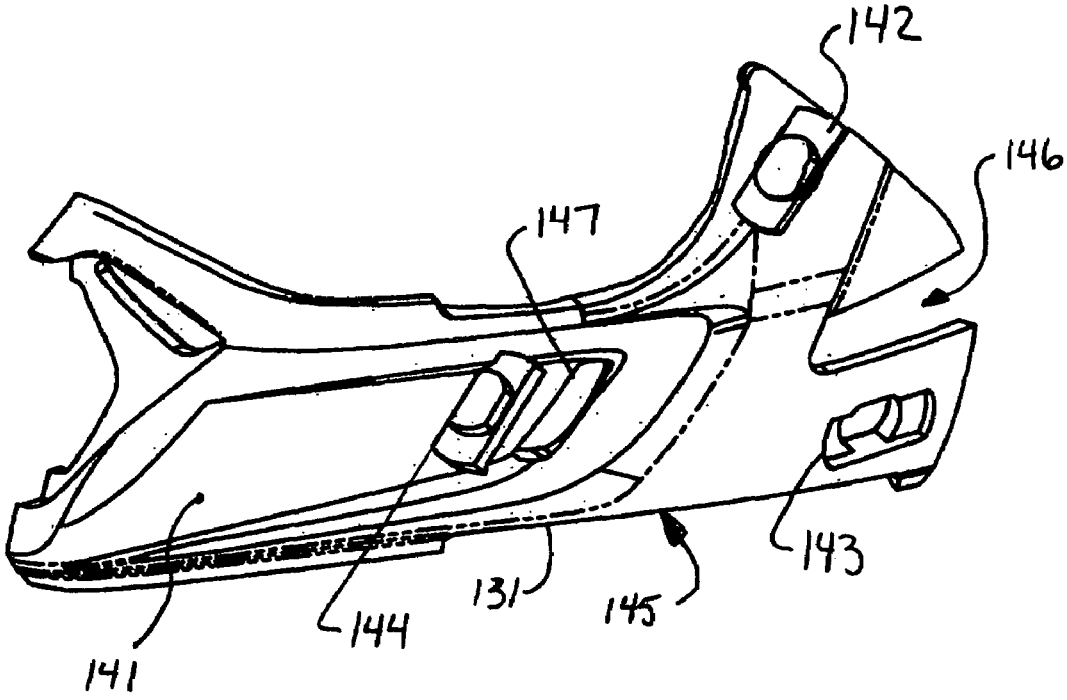
FIG. 4 is a pictorial view of the chin bar pad according to one embodiment of the present invention.

FIG. 4 is a pictorial view of the outer surface 145 of a chin bar pad 131 according to some embodiments of the present invention. The inlet duct 147 allows for air flow from outside the helmet to be routed in through the chin bar. In some embodiments, a plurality of inlet ducts may be used. The chin bar pad depression 141 allows for a recess in the outer shell such that air flow into the inlet duct 147 is facilitated. The inlet duct typically will have a corresponding hole in the helmet shell to allow for air flow. The chin bar pad slot 146 allows for the helmet fastening strap to be routed through the chin bar pad 131 in some embodiments. The clip holes 142, 143, 144 are used to mount clips that attach the chin bar pad 131 to the cheek pad in some embodiments.

Figure 5:
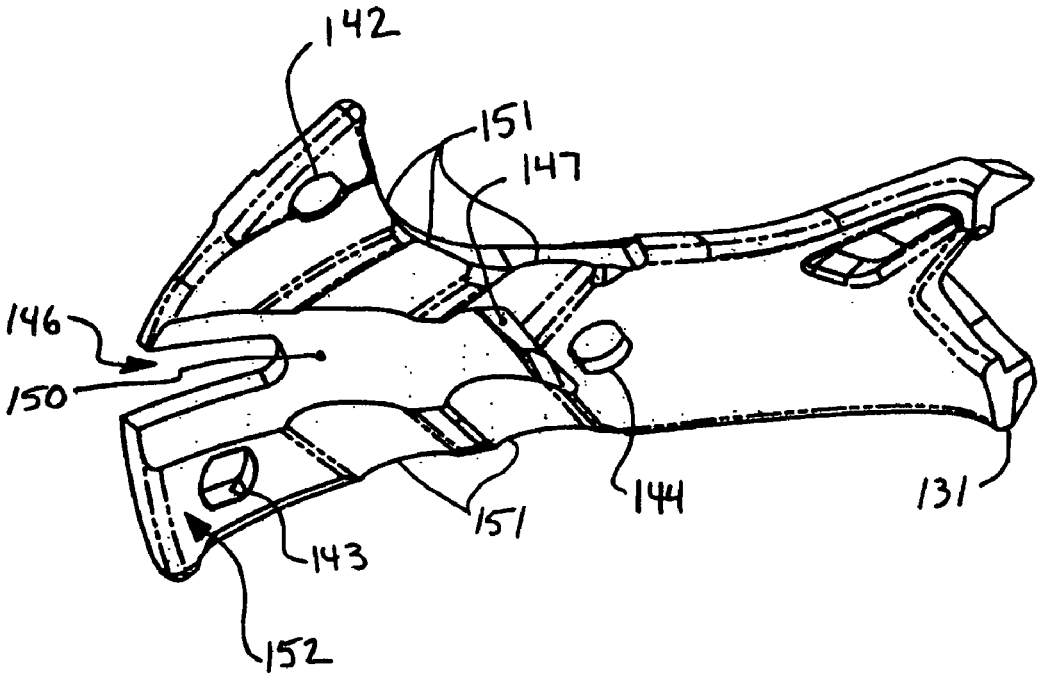
FIG. 5 is another pictorial view of the chin bar pad according to one embodiment of the present invention.

FIG. 5 is a pictorial view of the inner surface 152 of a chin bar pad 131. The inlet duct 147 allows for air flow from outside the helmet to be routed in through the chin bar. The large duct 150 allows for fluidic coupling of the depressions 151 on the inner surface 152 of the of the chin bar pad 131 to the inlet duct 147. When air flows through the inlet duct 147, and the inner surface 152 of the chin bar pad 131 is in substantial contact with a cheek pad, or a user's face, the depressions 151 may become ducts for air flow. The air flow through the inlet duct 147 may draw air through the depressions 151 via the large duct 150 using a venturi effect, or may force air out through the depressions 151, or may provide simply provide air passage for convective cooling, or may work using a combination of these or other effects. The end of the depressions 151 not coupled to the large duct 150 may continue to the outside edge of the inner surface 152 of the chin bar pad 131 in some embodiments, fluidically coupling the large duct 150 through the depressions 151 to the outside air. The clip holes 142, 143, 144 are used to mount clips that attach chin bar pad 131 to the cheek pad in some embodiments. In some embodiments, the chin bar pad is attached to the cheek pad using other attachment methods, such as Velcro, injection molded snaps, or using snaps that are molded into the cheek pad base. In some embodiments, chin bar pad slot 146 allows for the through passage of a helmet fastening strap.

Figure 6:
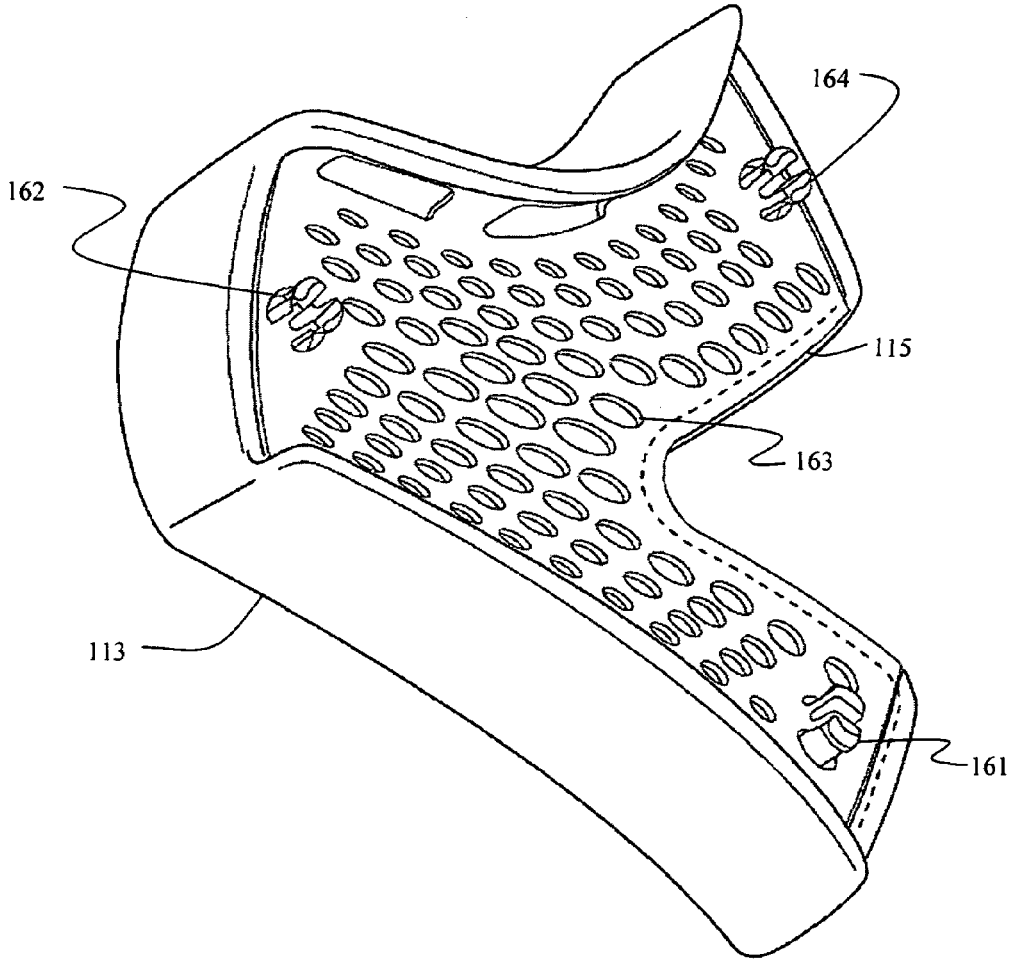
FIG. 6 is a pictorial view of a cheek pad according to one embodiment of the present invention.

FIG. 6 depicts a cheek pad 113 according to some embodiments of the present invention. The cheek pad base 115 is adapted to mount against the chin bar pad. The holes 163 in the cheek pad base 115 allow for air flow through the cheek pad base 115. Air flow provides ventilation through the cheek pad 113 and facilitates fluidic coupling between the depressions in the chin bar pad and cheek pad 113. The cheek pad 113 may be covered in one or more layers, which may be used to provide comfort to the user, to wick water, or for other purposes. Clip mounts 161, 162, 164 allow for attachment of the cheek pad to the chin bar pad in some embodiments.

Figure 7:
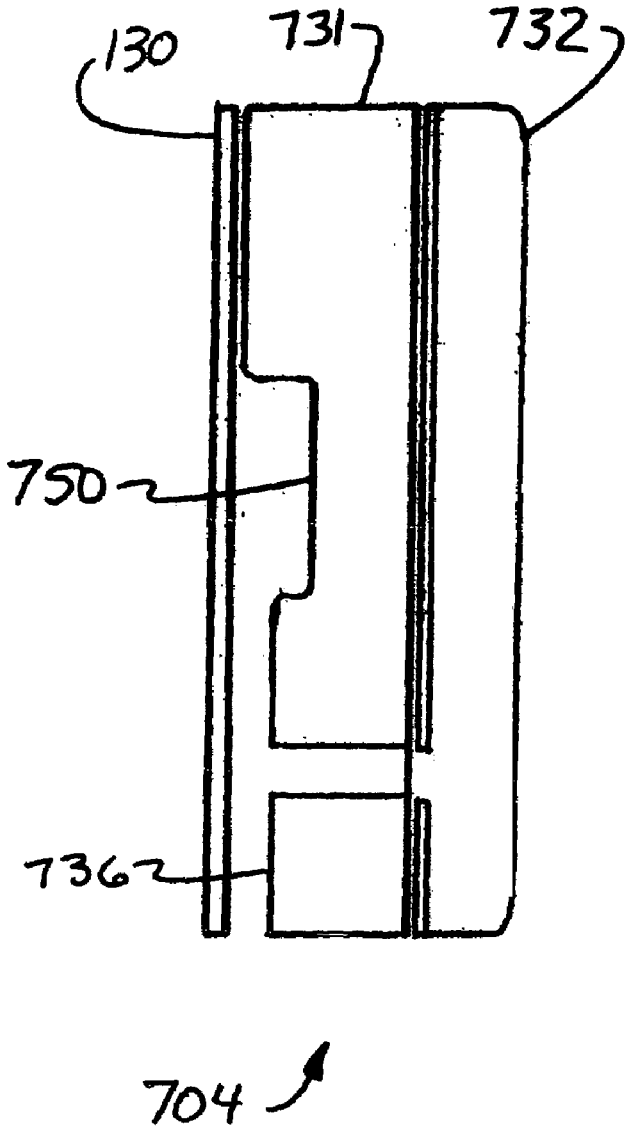
FIG. 7 is a pictorial cut away view of a chin bar according to one embodiment of the present invention with the ridged ducts adjacent to the helmet shell.
Figure 8:
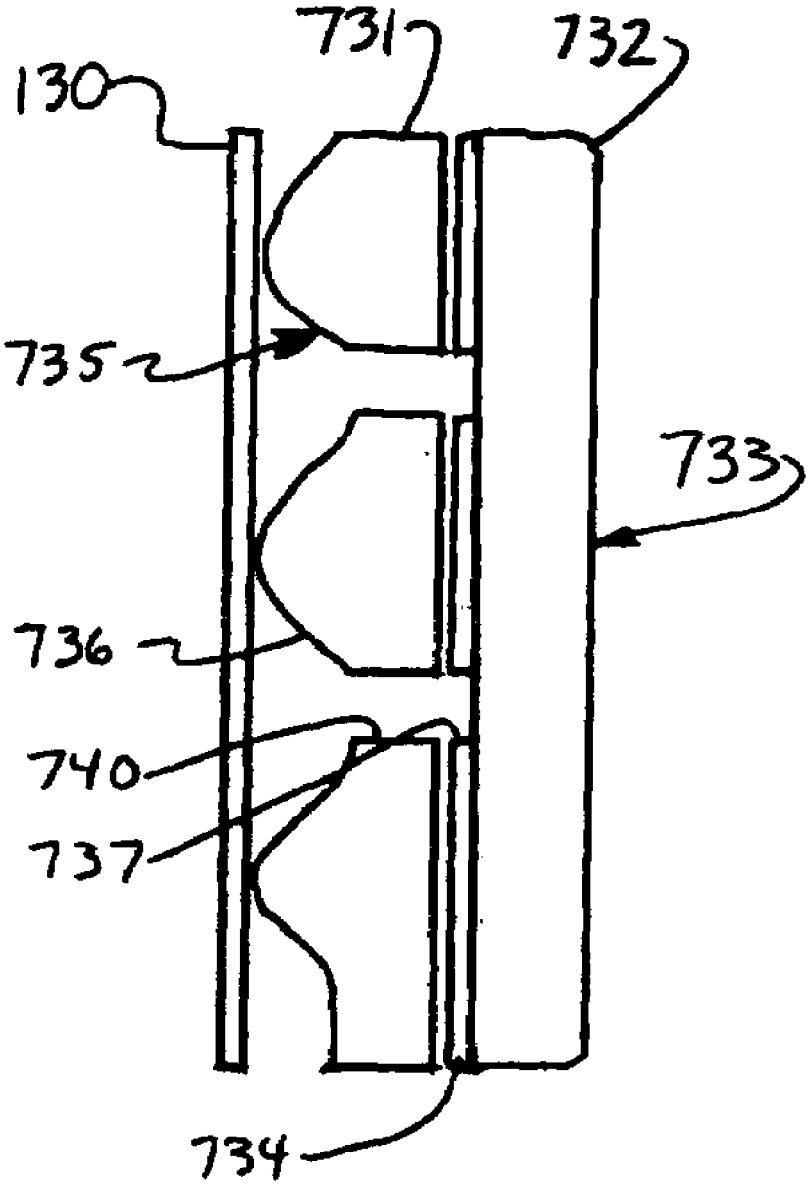
FIG. 8 is another pictorial cut away view of a chin bar according to one embodiment of the present invention with the ridged ducts adjacent to the helmet shell.

FIGS. 7 and 8 represent a cross-sectional view of the chin bar 704 according to some embodiments of the present invention. The chin bar outer shell portion 130 is lined with a chin bar pad 731 which is in substantial contact with the chin bar outer shell portion 130 in this embodiment. The outside surface 735 of the chin bar pad 731 has an uneven top surface which includes depressions 736 that form a ridged duct portion of the chin bar pad 731. A large duct 750 is fluidically coupled to the air outside the helmet by a through hole in the outer shell portion 130 or through other means. The large duct 750 is fluidically coupled to depressions 736 in this embodiment.

A perpendicular cross sectional view from that shown in FIG. 7 is shown in FIG. 8. Through holes 740 which are through the chin bar pad 731 fluidically couple the depressions 736 to the interior of the chin bar pad in this embodiment. A cheek pad 732 may be used between the user and the chin bar pad 731 in some embodiments. The cheek pad 732 may have a cheek pad base 734 in some embodiments. The cheek pad base 734 may have holes 737 which align with the through holes 740 in some embodiments. The cheek pad base may have a cheek pad cover 733 in some embodiments.

Figure 9:
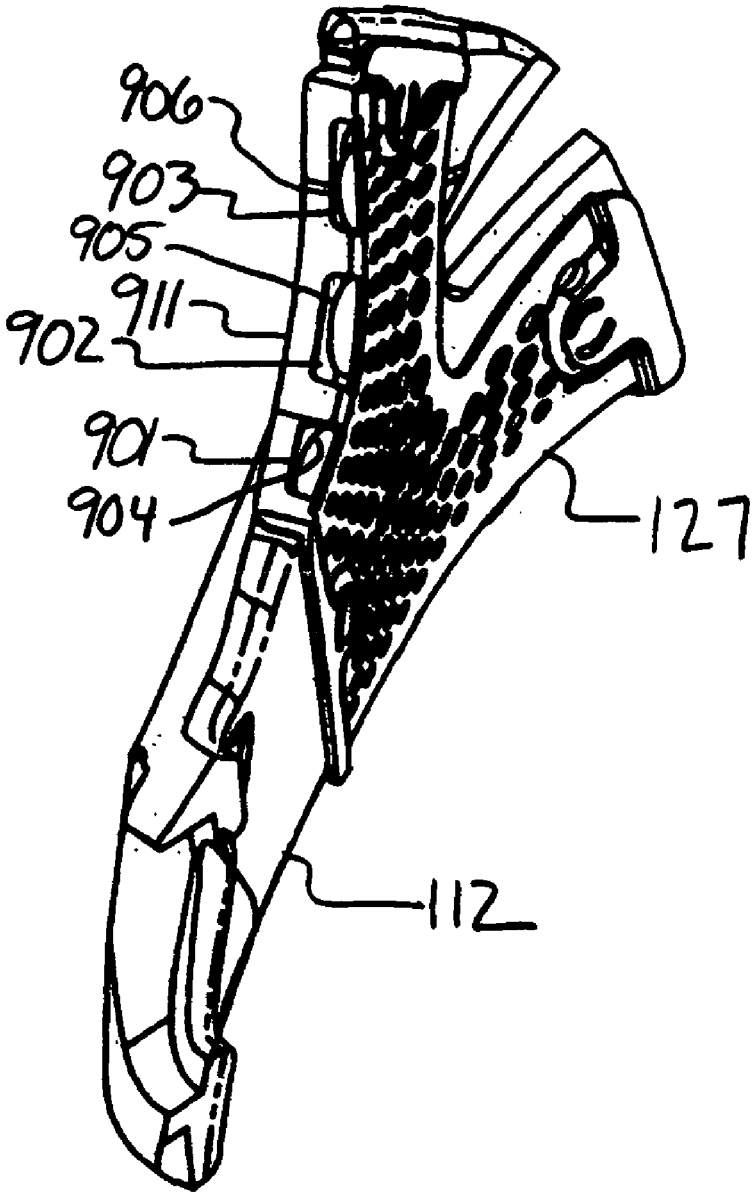
FIG. 9 is a pictorial view of a cheek pad base and chin bar pad according to one embodiment of the present invention.
Figure 10:
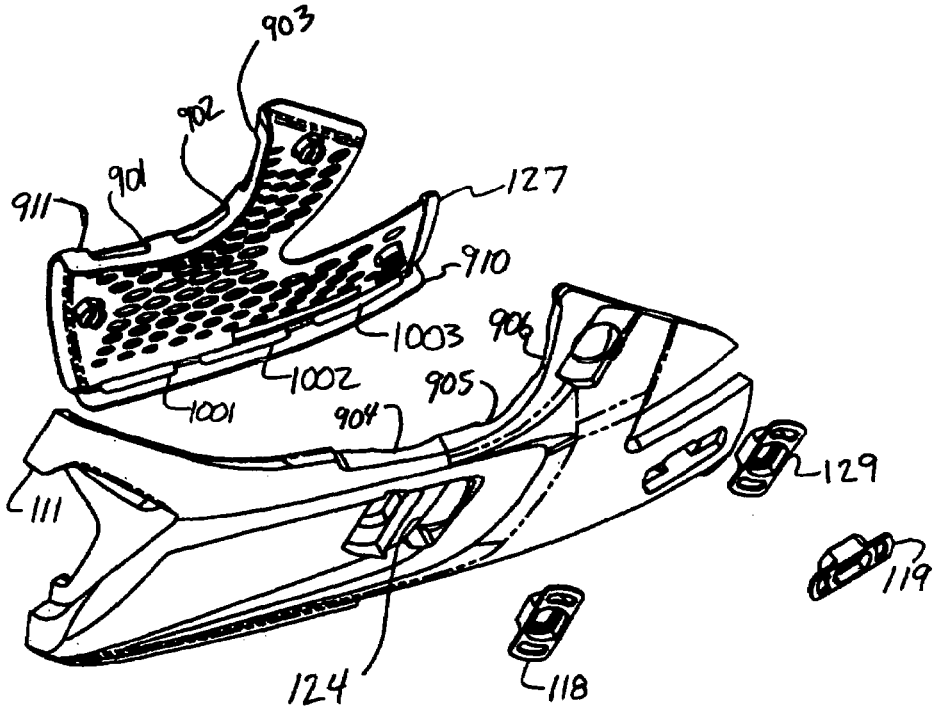
FIG. 10 is a pictorial view of a cheek pad base and chin bar pad according to one embodiment of the present invention

In some embodiments of the present invention, as seen in FIGS. 9 and 10, cheek pad base 127 has a cheek pad base top 911 and bottom 910. Cheek pad base top 911 and bottom 910 overlap the chin bar pads 111, 112. The cheek pad base top 911 has slots 901, 902, 903 that allow air flow through the cheek pad base top 911 and into, or out of, depressions 904, 905, 906 in the chin bar pad. The depressions 904, 905, 906 are also seen as the depressions 151 of FIG. 5. The cheek pad base bottom 910 has slots 1001, 1002, 1003 that allow air flow through the cheek pad base bottom 910 and into, or out of, depressions in the chin bar pad.

As evident from the above description, a wide variety of embodiments may be configured from the description given herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

I claim:

1. A motorcycle helmet comprising:
an outer shell;
a chin bar; wherein said chin bar comprises:
a chin bar pad;
said chin bar pad comprising;
an inlet duct adapted to receive air flow; and
a ridged duct portion, wherein said ridged duct portion is fluidically coupled to said inlet duct; and
a cheek pad, said cheek pad attached to the interior surface of said chin bar pad,
wherein said cheek pad comprises;
a cheek pad base; and
a cheek pad cushion
wherein said cheek pad base comprises holes in its structure.

2. The motorcycle helmet of claim 1, wherein said holes are aligned predominantly along the depressions of said ridged duct portion.

3. The motorcycle helmet of claim 1 wherein said cheek pad base is in physical contact with said ridged duct portion.

4. A helmet comprising:
an outer shell;
a chin bar; and
a front opening, said front opening in said outer shell above said chin bar,
wherein said chin bar comprises:
a chin bar pad; said chin bar pad comprising;
an inlet duct adapted to receive air flow; and
a ridged duct portion, wherein said ridged duct portion is fluidically coupled to said inlet duct, and wherein said ridged duct portion is predominantly located along the interior surface of said chin bar pad, and wherein said ridged duct portion comprises a plurality of ridged ducts, some of said plurality of ridged ducts fluidically coupled to said inlet duct on one end of the ducts and fluidically coupled to the bottom of said helmet on the other end of the ducts.

5. A helmet comprising:
an outer shell;
a chin bar; and
a front opening, said front opening in said outer shell above said chin bar,
wherein said chin bar comprises:
a chin bar pad; said chin bar pad comprising;
an inlet duct adapted to receive air flow; and
a ridged duct portion, wherein said ridged duct portion is fluidically coupled to said inlet duct, and wherein said ridged duct portion is predominantly located along the exterior surface of said chin bar pad between said chin bar pad and said outer shell.

6. The helmet of claim 5, wherein said ridged duct portion comprises a plurality of ridged ducts, some of said plurality of ridged ducts fluidically coupled to said inlet duct on one end of the ducts and fluidically coupled to the front opening of said helmet on the other end of the ducts.

7. The helmet of claim 6 wherein said plurality of ridged ducts are fluidically coupled to the interior surface of said chin bar pad by holes through said chin bar pad.

8. The helmet of claim 5, wherein said ridged duct portion comprises a plurality of ridged ducts, some of said plurality of ridged ducts fluidically coupled to said inlet duct on one end of the ducts and fluidically coupled to the bottom of said helmet on the other end of the ducts.

9. The helmet of claim 8 wherein said plurality of ridged ducts are fluidically coupled to the interior surface of said chin bar pad by holes through said chin bar pad.

* * * * *